US005447764A

United States Patent [19]

Langford

[11] Patent Number: 5,447,764

[45] Date of Patent: Sep. 5, 1995

[54] INSULATED RETAINER FOR A BEVERAGE CONTAINER

[76] Inventor: Mark H. Langford, 7349 Reindeer Trail, San Antonio, Tex. 78238

[21] Appl. No.: 935,858

[22] Filed: Aug. 26, 1992

Related U.S. Application Data

[63] Continuation of Ser. No. 660,790, Feb. 26, 1991, abandoned.

[51] Int. Cl.[6] ..... B65D 23/00; B65D 81/18

[52] U.S. Cl. ..... 428/36.9; 428/33; 428/119; 220/560; 220/737; 220/739; 220/903

[58] Field of Search ..... 220/903, 560, 737, 739; 428/36.9, 33, 34.1, 36.5, 36.8, 68, 119, 131, 215

[56] References Cited

U.S. PATENT DOCUMENTS 4,721,216 1/1988 Kinder ..... 215/100.5

*Primary Examiner*—Charles R. Nold

*Attorney, Agent, or Firm*—Gunn, Lee & Miller

[57] ABSTRACT

An insulated retainer (10) for a beverage container. The retainer (10) is comprised of a cylindrical sleeve (12) with an open top (16) and open bottom (18), the bottom (18) having a flexible base (14), thereby providing stability to the beverage container.

14 Claims, 3 Drawing Sheets

INSULATED RETAINER FOR A BEVERAGE CONTAINER

This is a continuation application of copending application Ser. No. 07/660,790 filed Feb. 26, 1991, now abandoned, the specifications of which are hereby incorporated by reference.

FIELD OF THE INVENTION

The present invention relates to holders or retainers for beverage containers and, more particularly, to an insulated sleeve for enclosing a beverage container. The insulated sleeve contains at one end thereof, a broad flexible flat base.

BACKGROUND

Persons living in warmer climates frequently purchase sleeve insulated beverage retainers in which to place their cold canned or bottled beverages. However, frequently the consumer finds that they are in a place, such as an automobile, boat or in the work place, where the sleeve insulation wrapped beverage container cannot be safely placed down, without the danger of tip-over. Thus, a beverage holder or retainer designed to more easily retain and stabilize the beverage on uneven surfaces is desirable. However, the beverage retainer should also be inexpensive, aesthetically pleasing, and convenient to handle and store.

Prior art patents have addressed the stability problem in a number of ways. U.S. Pat. No. 4,510,665 (Schuerer 1985) discloses a beverage insulating container that has a base having a larger diameter than the container sleeve. The sleeve and the base are made of unicellular foam.

U.S. Pat. No. 4,681,239 (Manns et al. 1987) discloses an insulated foam container which contains a cylindrical recess in the base.

U.S. Pat. No. 3,028,702 (St. Cyr 1962) discloses a cup holder formed from a cylindrical container which is sheathed in a bead-filled, deformable fabric skin. This allows the container to be placed on an irregular surface and maintain a generally upright posture.

U.S. Pat. No. 4,462,444 (Larson 1984) discloses an insulated container for holding a beverage. The container has stitching on the jacket cover. Thus, the cover provides certain advantages, among other things, allowing moisture to drain off the can.

Design Patent No. 309,073 (Robinson 1990) discloses a design for an insulated sheath to hold a container that has a base broader than the vertical container retaining sleeve. The sleeve tapers into the base.

None of the prior art discloses a broad, flexible base with an insertable sleeve similar to the present invention. Applicant's invention allows for an improved cylindrical sheath enclosed beverage container device which will permit for stability on uneven surfaces, yet which retains the lightweight and ease of handling and storage found on a baseless insulation sheath.

SUMMARY OF THE INVENTION

The device of the present invention provides a beverage container retainer dimensioned to enclose within a cylindrical, foam insulated sheath, a standard twelve ounce beverage can or bottle.

The invention comprises a foam insulating, beverage retaining, cylindrical sheath, open on both ends. The sheath is dimensioned to receive the beverage container therein. On one end of the sheath is a flexible, flat circular base member which is securely attached at an inner perimeter thereof to the insulating sheath. The walls of the insulating sheath join the top surface of the base member in approximately perpendicular relation.

DESCRIPTION OF THE PREFERRED EMBODIMENT

Figure 1:
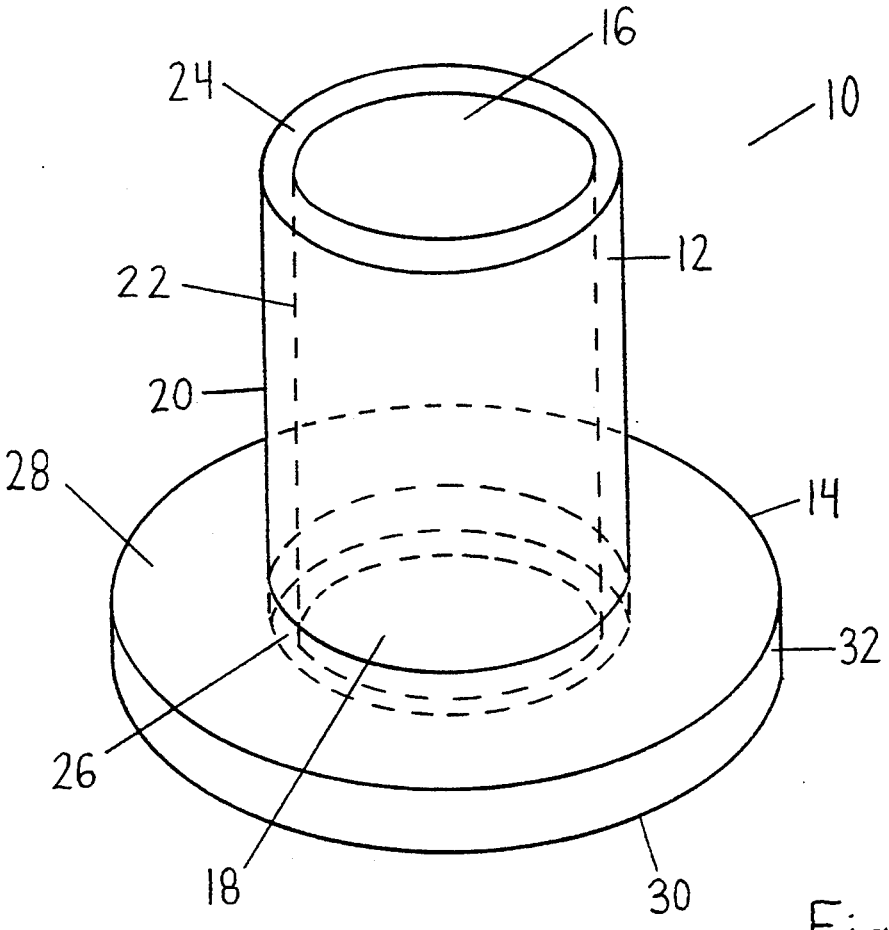
FIG. 1 is a prospective view of the beverage retainer.

The beverage retainer (10) is illustrated in FIG. 1. Referring now to FIG. 1 it is seen that beverage retainer (10) is comprised of two main components, the sleeve (12) and the base (14).

Sleeve (12) is generally cylindrical and constructed of a flexible foam material known in the art as Nitrile. Nitrile is a flexible, closed cell foam composed of a vulcanized, gas-expanded blend of elastomeric materials (Nitrile Butadiene Rubber) and Poly Vinyl Chloride along with a variety of plasticizers, fillers and other miscellaneous materials to obtain the desired properties. The material is available from many suppliers—among others, Halstead Industries, 4230 Beachwood Drive, Greensboro, N.C. 27410. However, the novelty of Applicant's invention does not lie in the type of material used, rather in the geometry and flexibility of the base—which provides for stability. Sleeve (12) has an open top (16) and an open bottom (18). Sleeve (12) also has an outer side wall (20) and an inner side wall (22), the side walls being cylindrically arranged about the longitudinal axis and in general parallel relation. Sleeve (12) is truncated at an upper perimeter (24) and a bottom perimeter (26).

Base (14) is generally tabular with a flat top surface (28) and a flat bottom surface (30), joined to a base perimeter (32). As can be seen in FIG. 1, top surface (28) joins outer side wall (20) in a generally perpendicular relation. Base (14) is comprised of a flexible, resilient material capable of maintaining the stability of the beverage container on an uneven surface such as: automobile seat, dash, floor or the like. Materials from which base (14) may be constructed include the following: Nitrile or unicellular foam. Base (14) should have a non-skid surface comprising bottom surface (30). The materials set forth in the previous sentence are generally "non-skid" surfaces. In the alternative, bottom surface (30) may be treated or coated with an adhesive or course material to increase friction with the surface on which beverage retainer (10) rests. Base (14) may be attached to sleeve (12) by glue or other adhesives.

Figure 2:
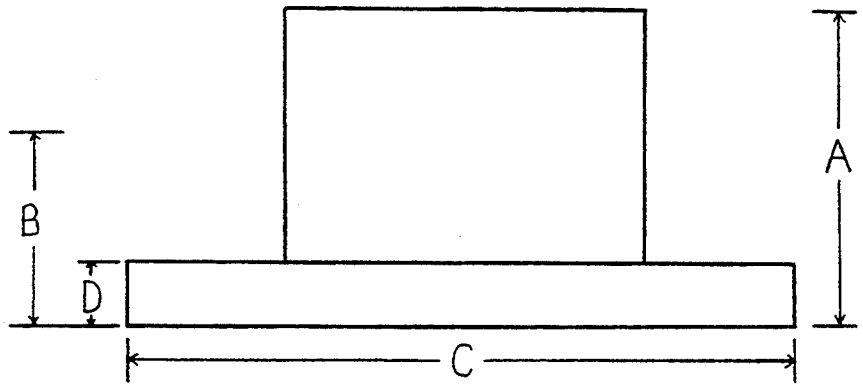
FIG. 2 is an elevational view of the beverage retainer.

FIG. 2 illustrates the dimensions of beverage retainer (10) and the two preferred embodiments thereof. Dimension "A" describes the height of beverage retainer in a first preferred embodiment. This dimension is approximately $4\frac{1}{2}$ inches, but may be between four and five inches. This dimension is sufficient to substantially enclose the side walls of most 12-ounce beverage containers. The second preferred embodiment includes beverage retainer (10) whose height is given by dimension "B" and is about $1\frac{1}{2}$ inches, but may be between $1\frac{1}{4}$ and $1\frac{3}{4}$ inches. Dimension "C" for either embodiment is approximately six inches, preferably between $4\frac{1}{2}$ and seven inches. Dimension "D" describes the thickness of the base. For the preferred material, Nitrile, the thickness of the base is between $\frac{3}{8}$ inch and $\frac{5}{8}$ inch thick. These dimensions allow for flexibility sufficient to withstand placement of beverage retainer (10) on most uneven surfaces.

Figure 3B:
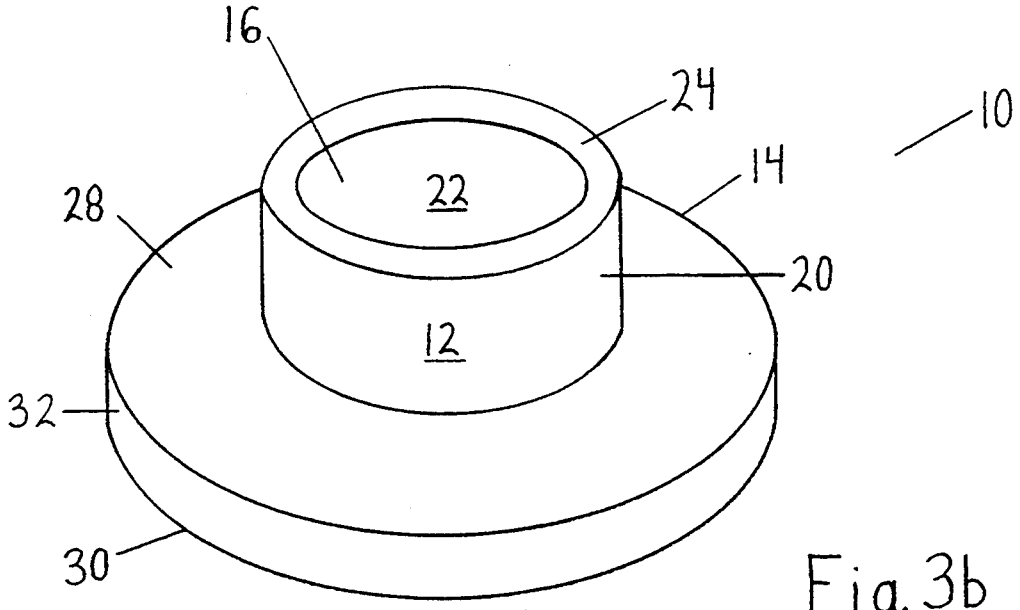
FIGS. 3, 3*a* and 3*b* are elevational views of an alternate preferred embodiment of the beverage retainer.
Figure 3A:
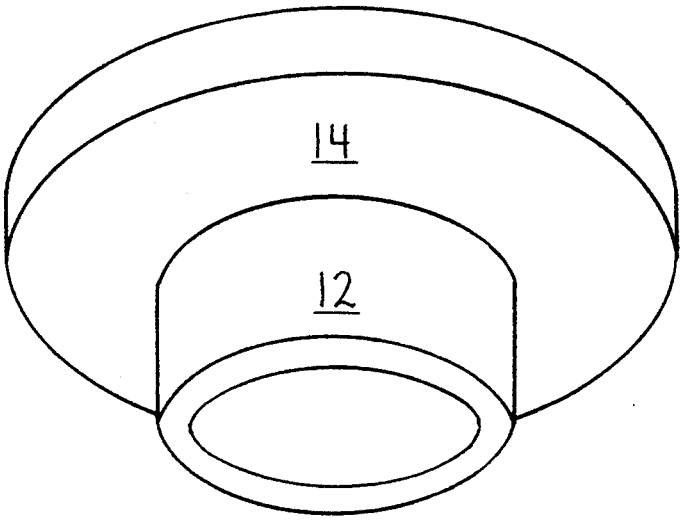
Figure 3:
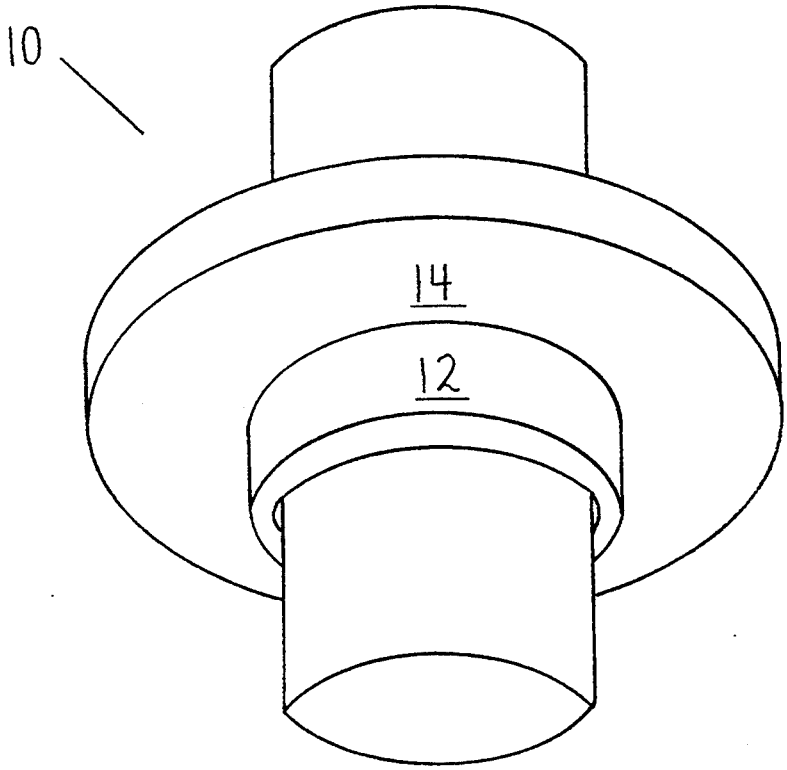

As can be seen in FIGS. 3, 3*a* and 3*b*, beverage retainer (10) may be used in an aqueous environment. The preferred dimensions allow the securing of a beverage container in an upright position while floating on the surface of water, as in a pool. The second preferred embodiment (illustrated by dimension "B" in FIG. 2) and further illustrated by the embodiment shown in FIG. 3, is particularly adapted to the aqueous environment. Note in FIG. 3 that beverage retainer (10) is used "upside down."

Figure 4:
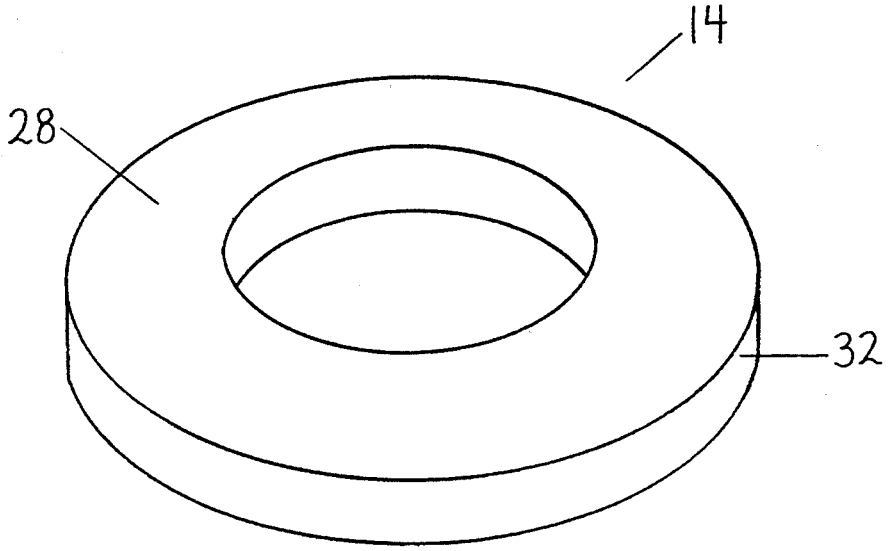
FIG. 4 is prospective view of the base of the beverage retainer.

FIG. 4 discloses another novel feature of Applicant's invention. FIG. 4 illustrates base (14) separate and apart from sleeve (12). In an alternate preferred embodiment, base 14 is removably attached to the bottom of sleeve (12) by friction means alone. That is, base (14) is dimensioned such that the interior circular opening has a diameter just slightly smaller than the outer diameter of sleeve 12. Therefore, when base (14) is placed on the bottom of sleeve (12), there is a slight compression fit, the two pieces being held by friction rather than glue or other adhesive. While this particular embodiment of Applicant's invention is not as structurally rigid as the preferred embodiments set forth above, which have the base fixedly attached to the sleeve, it nonetheless allows the consumer to purchase the base alone and apart from the sleeve. Additionally, it allows one to easily store the beverage retainer, by removing the base, rolling it up and inserting it into the center of the sleeve.

Although the invention has been described in connection with the preferred embodiment, I did not intend it to limit the invention to a particular form set forth, but on the contrary, it is intended to cover such alternatives, modifications and equivalents as may be included the spirit of the scope of the invention as defined by the appended claims.

I claim:

1. A device for holding a beverage container, the device comprising:

a cylindrical sleeve made of nitrile, said sleeve having inner and outer side walls, and open top end and an open bottom end, said sleeve comprised of a flexible material and dimensioned to at least partially enclose the side walls of a standard twelve ounce beverage container; and a flexible base made of nitrile, fixedly attached to the outer side of wall of said cylindrical sleeve at the bottom end thereof, said base being generally tabular with a flat top surface and a flat bottom surface, the top surface of said base being parallel with the bottom surface of said base, said base being circular in shape, and comprised of a solid, resilient, flexible material, the top surface of said base joining said cylindrical sleeve in substantially perpendicular relation, said base being of sufficient diameter so as to prevent a top-over on uneven surfaces, wherein said base is between $\frac{1}{8}$ and $\frac{1}{2}$ inch thick.

2. A device as described in claim 1 wherein said sleeve is between four and five inches in height.

3. A device as described in claim 1 wherein said sleeve is between $1\frac{1}{4}$ and $1\frac{3}{4}$ inches in height.

4. A device as described in claim 1 wherein said base is between $4\frac{1}{2}$ and seven inches in diameter.

5. A device as described in claim 1 wherein said sleeve is between four and five inches in height and said base is between $4\frac{1}{2}$ and seven inches in diameter.

6. The device as described in claim 1 wherein the bottom surface of said base is treated with a non-skid coating.

7. A device for holding a beverage container, the device comprising:

a cylindrical sleeve made of nitrile, said sleeve having inner and outer side walls an open top end and an open bottom end, said sleeve comprised of a flexible foam material and dimensioned to at least partially enclose the side walls of a standard twelve ounce beverage container; and a flexible base made of nitrile, removably attached to the outer side of wall of said cylindrical sleeve at the bottom end thereof, said base being generally tabular with a flat top surface and a flat bottom surface, the top and bottom surfaces being parallel, said base being circular in shape, and comprised of a solid, resilient, flexible material, the top surface of said base joining said cylindrical sleeve in substantially perpendicular relation, wherein said base is between $\frac{1}{8}$ and $\frac{1}{2}$ inch thick.

8. A device as described in claim 7 wherein said sleeve is between four and five inches in height.

9. A device as described in claim 7 wherein said device is between $1\frac{1}{4}$ and $1\frac{3}{4}$ inches in height.

10. A device as described in claim 7 wherein said base is between $4\frac{1}{2}$ and seven inches in diameter.

11. A device as described in claim 7 wherein said sleeve is between four and five inches in height and said base is between $4\frac{1}{2}$ and seven inches in diameter.

12. The device as described in claim 7 wherein the bottom surface of said base is treated with a non-skid coating.

13. A device for holding a beverage container, the device comprising:

a cylindrical sleeve means having an open top end and open bottom end, said sleeve means comprised of flexible nitrile material and between four and five inches in height; and a base, said base fixedly attached to said sleeve means at the bottom end thereof, said base being generally disk shaped with a flat upper and a flat lower surface, the upper and lower surface being parallel, and comprised of a Nitrile material between $\frac{1}{8}$ and $\frac{1}{2}$ inches thick, and having a diameter of between $4\frac{1}{2}$ and seven inches.

14. The device as described in claim 6 wherein said sleeve is between four and five inches high.

* * * * *